US007194868B2

(12) United States Patent
Yoshida et al.

(10) Patent No.: US 7,194,868 B2
(45) Date of Patent: Mar. 27, 2007

(54) MULTIPLE ICE MAKING DECISION METHOD AND OPERATION METHOD FOR AUTOMATIC ICE MAKING MACHINE

(75) Inventors: Kazuhiro Yoshida, Toyoake (JP); Naoshi Kondo, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 144 days.

(21) Appl. No.: 11/035,265

(22) Filed: Jan. 12, 2005

(65) Prior Publication Data

US 2005/0155360 A1 Jul. 21, 2005

(30) Foreign Application Priority Data

Jan. 15, 2004 (JP) ..... 2004-008438

(51) Int. Cl.
*F25C 1/00* (2006.01)

(52) U.S. Cl. ..... 62/66; 62/188; 62/233

(58) Field of Classification Search ..... 62/66, 62/135, 188, 233
See application file for complete search history.

(56) References Cited

U.S. PATENT DOCUMENTS 5,291,747 A * 3/1994 Sakai et al. ..... 62/135
5,479,707 A 1/1996 Alvarez et al.
5,829,257 A 11/1998 Newman et al.
6,125,639 A * 10/2000 Newman et al. ..... 62/74
6,282,909 B1 9/2001 Newman et al.
6,612,118 B2 * 9/2003 Billman et al. ..... 62/74

FOREIGN PATENT DOCUMENTS

| | | |
|---|---|---|
| EP | JP 64-84065 | 3/1989 |
| EP | JP 04-003868 | 1/1992 |
| EP | JP 05-126445 | 5/1993 |
| EP | JP 05-288441 | 11/1993 |
| EP | JP 06-313657 | 11/1994 |
| EP | 0 683 365 | 11/1995 |
| JP | 2002-062002 | 2/2002 |

* cited by examiner

*Primary Examiner*—William E. Tapolcai
(74) *Attorney, Agent, or Firm*—Koda & Androlia

(57) ABSTRACT

Multiple ice making is determined according to a time needed for an ice making step or a change in time in which a refrigerant temperature drops.

An ice making machine alternately repeats an ice making step of cooling ice making plates 10 and 10 where an evaporation pipe 14 connected to a refrigeration system 12 by circulatively supplying a refrigerant to the evaporation pipe 14, and producing lumps of ice M by circulatively supplying ice making water in an ice-making-water tank 22, and a deicing step of separating the lumps of ice M produced at the ice making plates 10 and 10. When the ice making step at which the time needed from the start of the ice making step to the end thereof becomes shorter than a normal ice making time is consecutively detected by a predetermined number of times, it is decided that multiple ice making has occurred and the ice making machine is stopped.

2 Claims, 7 Drawing Sheets

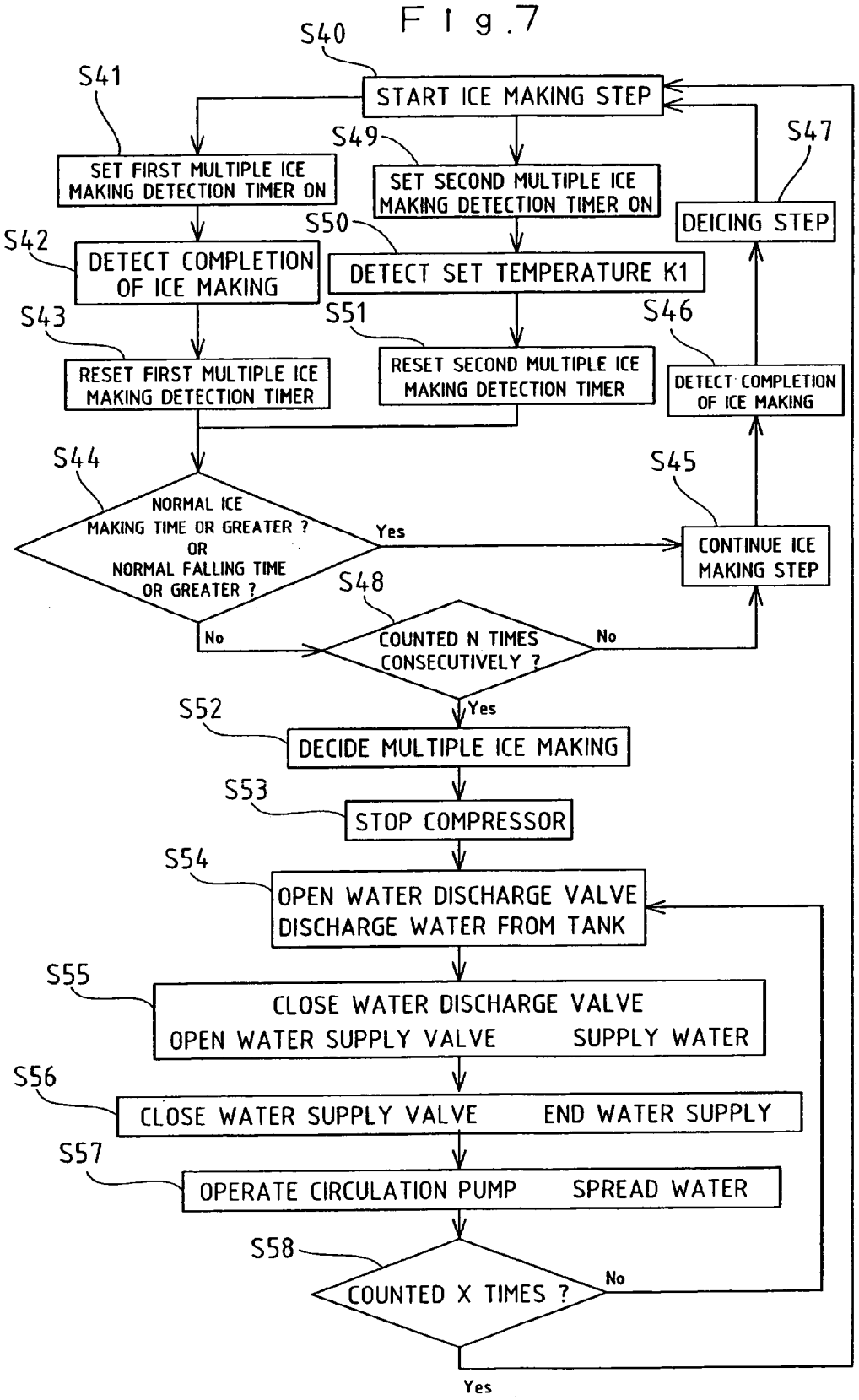
Fig.7
S40
START ICE MAKING STEP
S41
SET FIRST MULTIPLE ICE MAKING DETECTION TIMER ON
S49
SET SECOND MULTIPLE ICE MAKING DETECTION TIMER ON
S47
DEICING STEP
S42
DETECT COMPLETION OF ICE MAKING
S50
DETECT SET TEMPERATURE K1
S43
RESET FIRST MULTIPLE ICE MAKING DETECTION TIMER
S51
RESET SECOND MULTIPLE ICE MAKING DETECTION TIMER
S46
DETECT COMPLETION OF ICE MAKING
S44
NORMAL ICE MAKING TIME OR GREATER ? OR NORMAL FALLING TIME OR GREATER ?
Yes
S45
CONTINUE ICE MAKING STEP
S48
COUNTED N TIMES CONSECUTIVELY ?
No
No
Yes
S52
DECIDE MULTIPLE ICE MAKING
S53
STOP COMPRESSOR
S54
OPEN WATER DISCHARGE VALVE DISCHARGE WATER FROM TANK
S55
CLOSE WATER DISCHARGE VALVE OPEN WATER SUPPLY VALVE SUPPLY WATER
S56
CLOSE WATER SUPPLY VALVE END WATER SUPPLY
S57
OPERATE CIRCULATION PUMP SPREAD WATER
S58
COUNTED X TIMES ?
No
Yes

MULTIPLE ICE MAKING DECISION METHOD AND OPERATION METHOD FOR AUTOMATIC ICE MAKING MACHINE

TECHNICAL FIELD

The present invention relates to a multiple ice making decision method and an operation method for an automatic ice making machine which produces lots of lumps of ice by alternately repeating an ice making step and a deicing step.

BACKGROUND ART

Multiple types of ice making systems have been proposed for automatic ice making machines which continuously produce lumps of ice, and an adequate system is employed according to the usage. One of the systems known is a falling type ice making machine in which an evaporation pipe constituting a refrigeration system is provided at an ice making plate laid out vertically, ice making water is spread over and supplied to the ice making plate which is cooled by a refrigerant circulatively supplied to the evaporation pipe, thereby forming lumps of ice, and separates the obtained lumps of ice and let them fall off (see Japanese Patent Laid-Open Publication No. 2002-62002, for example).

The falling type ice making machine has an ice-making-water tank for retaining a required amount of ice making water under the ice making plate, and is constructed in such a way as to pump out and supply the ice making water in the tank to the ice making plate by a circulation pump at the ice making step, collect the ice making water which has not become ice into the ice-making-water tank, and then feed the ice making water again toward the ice making plate. An ice guide plate is laid out tilted between the ice making plate and the ice-making-water tank, and a stocker is provided on the tilting lower end side of the ice guide plate, so that lumps of ice which fall from the ice making plate are discharged onto the stocker via the ice guide plate. A plurality of through holes are bored in the ice guide plate, so that ice making water falling from the ice making plate is collected into the ice-making-water tank via the through holes without flowing into the stocker. The stocker is provided with ice detection means which detects the storage of lumps of ice up to a predetermined level (detection of fullness), and the operation or stopping of the ice making machine is controlled by a detection signal from the ice detection means.

DISCLOSURE OF THE INVENTION

In the case where the operation or stopping of the ice making machine is controlled by the ice detection means provided at the stocker, as mentioned above, lumps of ice may be stored over the full-ice level to be stored on the ice guide plate or up to the layout position of the ice making plate unless fullness detection is done accurately due to an operational failure of the ice detection means. When lumps of ice excessively larger than normal ones are produced due to an abnormality in the control system or refrigeration system, separated lumps of ice may be hooked on the ice making plate or the ice guide plate and may remain near the ice making plate without being discharged into the stocker.

If the next ice making step is taken with lumps of ice stored near the ice making plate or lumps of ice remaining without being discharged into the stocker (abnormal state) as mentioned above, certain lumps of ice are melted by the ice making water supplied to the ice making plate but most of them remain without being melted, so that repetition of the ice making and deicing cycle gradually increases lumps of ice near the ice making plate. In this case, the pressure of those lumps of ice may deform or damage the ice making plate or the casing or the like which supports the ice making plate. However, so-called multiple ice making of producing new lumps of ice with lumps of ice present near the ice making plate in such a manner has not been detected at present.

The present inventors made various studies to find a solution to the problem and find out the following phenomenon to be a hint about it. When the next ice making step is taken with lumps of ice stored or the like near the ice making plate as mentioned above, a part of ice making water to be supplied to the ice making plate falls into the stocker, flowing along the lumps of ice stored or the like, and the amount to be collected into the ice-making-water tank becomes smaller. In case of deciding completion of ice making by detecting the water level in the ice-making-water tank dropping to a predetermined lower water level set previously, therefore, it was found out ice making would complete in a shorter time than at the ice making step in the normal state where lumps of ice are not stored or the like in the vicinity of the ice making plate.

In addition, lumps of ice near the ice making plate are melted with the ice making water and the melted cold water is flowed into the ice-making-water tank to lower the temperature of the ice making water in a short time. Thus, the outlet temperature of refrigerant circulating in the evaporation pipe which exchanges heat with the ice making plate lowers in a shorter time compared with the ice making step under the normal state.

Accordingly, the present invention has been proposed to suitably solve the problem of the prior art, and aims at providing a multiple ice making decision method and an operation method for an automatic ice making machine, which prevents damaging of the ice making plate or the like by determining multiple ice making based on a time needed for the ice making step or a time in which the temperature of the refrigerant drops and ensuring adequate measures.

Means for Solving the Problem

To overcome the problem and achieve the expected object, a multiple ice making decision method for an automatic ice making machine according to the present invention is a multiple ice making decision method for an automatic ice making machine, which alternately repeats an ice making step of cooling an ice making section where an evaporator constituting a refrigeration system by circulatively supplying a refrigerant to the evaporator, and producing lumps of ice by circulatively supplying ice making water, retained in an ice-making-water tank, to the ice making section, and a deicing step of separating the lumps of ice produced at the ice making section, characterized in that it is decided that multiple ice making has occurred when the ice making step at which a time needed from a start of the ice making step to an end thereof becomes shorter than a normal ice making time in a normal state is consecutively detected by a predetermined number of times.

To overcome the problem and achieve the expected object, a multiple ice making decision method for an automatic ice making machine according to the present invention is a multiple ice making decision method for an automatic ice making machine, which alternately repeats an ice making step of cooling an ice making section where an evaporator constituting a refrigeration system by circulatively supplying a refrigerant to the evaporator, and producing lumps of ice by circulatively supplying ice making water, retained in an ice-making-water tank, to the ice making section, and a deicing step of separating the lumps of ice produced at the ice making section, characterized in that it is decided that multiple ice making has occurred when an event that a time for a temperature at a refrigerant outlet of the evaporator to reach a preset temperature becomes shorter than a normal falling time in a normal state at the ice making step is consecutively detected by a predetermined number of times.

To overcome the problem and achieve the expected object, an operation method for an automatic ice making machine according to another invention of the present application is characterized in that an operation of the ice making machine is stopped when it is decided that multiple ice making has occurred by a multiple ice making decision method.

To overcome the problem and achieve the expected object, an operation method for an automatic ice making machine according to another invention of the present application is characterized in that when it is decided that multiple ice making has occurred by a multiple ice making decision method, a cycle of discharge of ice making water in the ice-making-water tank, supply of new ice making water to the ice-making-water tank and circulative supply of ice making water to the ice making section is repeated a predetermined number of times, with supply of the refrigerant to the evaporator being stopped.

EFFECT OF THE INVENTION

The multiple ice making decision method for an automatic ice making machine decides that multiple ice making has occurred by detecting shortening of the time needed for the ice making step or dropping of the refrigerant temperature at the outlet side of the evaporator, which is originated from multiple ice making, thus making it possible to take a measure to prevent the ice making plate or the like from being damaged by continuation of multiple ice making.

The operation method for an automatic ice making machine according to claim 3 stops the operation of the ice making machine when it is decided that multiple ice making has occurred by the multiple ice making decision method, thus making it possible to take a measure to prevent the ice making plate or the like from being damaged by continuation of multiple ice making.

The operation method for an automatic ice making machine according to claim 4 melts remaining lumps of ice using ice making water in the ice-making-water tank with the supply of the refrigerant to the evaporator being stopped, when it is decided that multiple ice making has occurred by the multiple ice making decision method, thereby making it possible to clear the multiple ice making state and ensure automatic restoration.

BRIEF DESCRIPTION OF DRAWINGS

FIG. 7 is a flowchart which is carried out by the multiple ice making decision method and the operation method according to the third embodiment.

BEST MODE FOR CARRYING OUT THE INVENTION

Preferred embodiments of a multiple ice making decision method and an operation method according to the present invention will now be described with reference to the accompanying drawings.

First Embodiment

Figure 1:
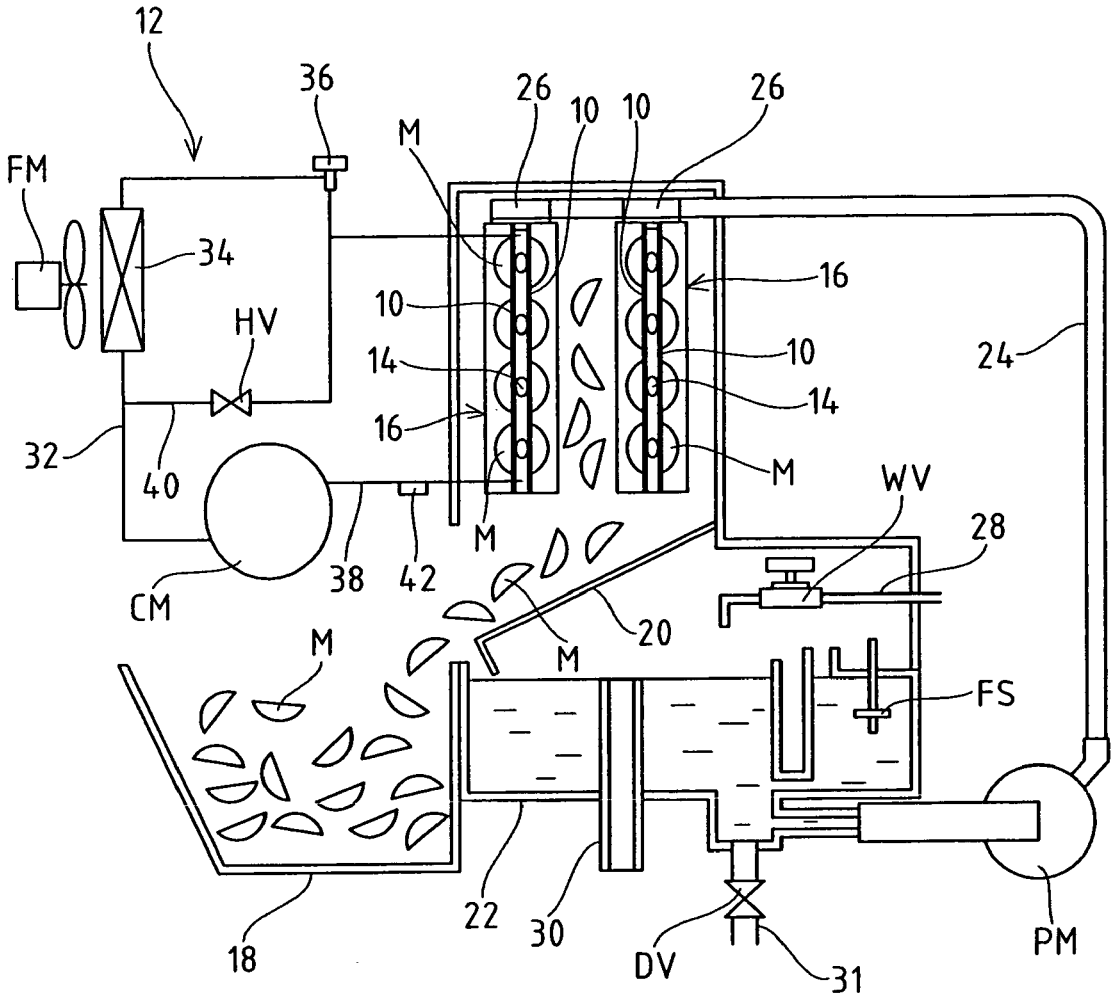
FIG. 1 is a schematic structural diagram of a falling type ice making machine for which a multiple ice making decision method and an operation method according to a first embodiment are executed.

FIG. 1 illustrates the schematic structure of a falling type ice making machine as an automatic ice making machine for which a multiple ice making decision method and an operation method according to the first embodiment are executed, and which is constructed in such a way that an evaporation pipe (evaporator) 14 constituting a refrigeration system 12 is tightly held and secured, zigzagged horizontally, between opposing sides (bottom sides) of a pair of ice making plates 10 and 10 arranged vertically, a refrigerant is circulated to the evaporation pipe 14 to forcibly cool the ice making plates 10 and 10 at an ice making step. In the first embodiment, a plurality of ice making sections 16 comprised of the pair of ice making plates 10 and 10 are laid out in parallel. An ice guide plate 20 which guides lumps of ice M, separated from the ice making plates 10 and 10 at a deicing step to a stocker 18 obliquely provided below is laid out immediately under the ice making sections 16 in a tilting state. Multiple through holes (not shown) are bored in the ice guide plate 20, so that ice making water supplied to the ice making surfaces (front sides) of the ice making plates 10 and 10 at the ice making step is collected and stored via the through holes of the ice guide plate 20 in an ice-making-water tank 22 positioned below. Ice detection means (not shown) which detects the fullness of lumps of ice M is provided inside the stocker 18, a first control unit 44 to be discussed later controls the operation or stopping of the ice making machine based on a fullness detection signal from the ice detection means.

An ice-making-water feeding pipe 24 led out from the ice-making-water tank 22 via a circulation pump PM is connected to ice-making-water spreaders 26 provided above the individual ice making sections 16. Multiple spread holes are bored in the individual ice-making-water spreaders 26 to let ice making water, pumped out from the ice-making-water tank 22 at the ice making step, to be spread and flow down to the ice making surfaces of the respective ice making plates 10 and 10, cooled down to the icing temperature, through the spread holes, thereby producing lumps of ice M of a desired shape on the ice making surfaces. At the deicing step, a hot gas valve HV disposed in the refrigeration system 12 is changed over to circulate a hot gas (high-temperature refrigerant) to the evaporation pipe 14 to thereby heat the ice making plates 10 and 10 and melt the icing surfaces of the lumps of ice M to the individual ice making surfaces.

A water supply pipe 28 connected to an external water system is located above the ice-making-water tank 22, and a predetermined amount of city water which is used as ice making water is supplied to the ice-making-water tank 22 by opening a water supply valve WV intervened in the water supply pipe 28. An overflow pipe 30 is provided at the ice-making-water tank 22 to define the storage amount of ice making water to be retained in the tank 22. Further, a water discharge pipe 31 is connected to the bottom of the ice-making-water tank 22, and is constructed in such a way as to be able to discharge ice making water remaining in the tank 22 out of the machine by opening a water discharge valve DV intervened in the water discharge pipe 31.

A float switch FS is provided at the ice-making-water tank 22. This float switch FS detects the height of the water level in the tank 22, and becomes an ON state when the height of the water level is higher than a preset defined water level WL and becomes an OFF state when it drops to the defined water level WL. In the embodiment, as the ice making step is started from the upper water level defined by the overflow pipe 30 and lumps of ice M are produced on the ice making plates 10 and 10 of each of the ice making sections 16, the water level in the ice-making-water tank 22 drops, and the specified water level WL is the lower water level when lumps of ice M are produced completely.

As shown in FIG. 1, in the refrigeration system 12, a gaseous refrigerant compressed by a compressor CM is condensed and liquefied at a condenser 34 through an outlet pipe 32, depressurized by an expansion valve 36, flows into the evaporation pipe 14 where it expands and evaporates at once, and exchanges heat with the ice making plates 10 and 10 of each ice making section 16 to cool down the ice making plates 10 and 10 below the freezing point. The gaseous refrigerant evaporated at the evaporation pipe 14 repeats the cycle of passing through an inlet pipe 38 and returning to the compressor CM.

Further, a hot gas pipe 40 is branched from the outlet pipe 32 of the compressor CM, and is connected to the inlet side of the evaporation pipe 14 through the hot gas valve HV. The hot gas valve HV is controlled in such a way as to be opened only at the deicing step and be closed at the ice making step. That is, the hot gas valve HV is opened at the deicing step to let the hot gas expelled from the compressor CM bypass the evaporation pipe 14 via the hot gas pipe 40 to heat the ice making plates 10 and 10 of each ice making section 16, thereby melting the icing surfaces of the lumps of ice M which are produced on the ice making surfaces so that the lumps of ice M fall off due to the dead weight. Symbol FM in FIG. 1 indicates a cooling fan for the condenser.

A temperature sensor 42 as temperature detection means which detects the temperature at the refrigerant outlet after heat exchange with the ice making plates 10 and 10 of each ice making section 16 is tightly provided at the inlet pipe 38 which connects to the refrigerant outlet side of the evaporation pipe 14. The temperature detected by the temperature sensor 42 is input to the first control unit 44 to be discussed later.

Figure 2:
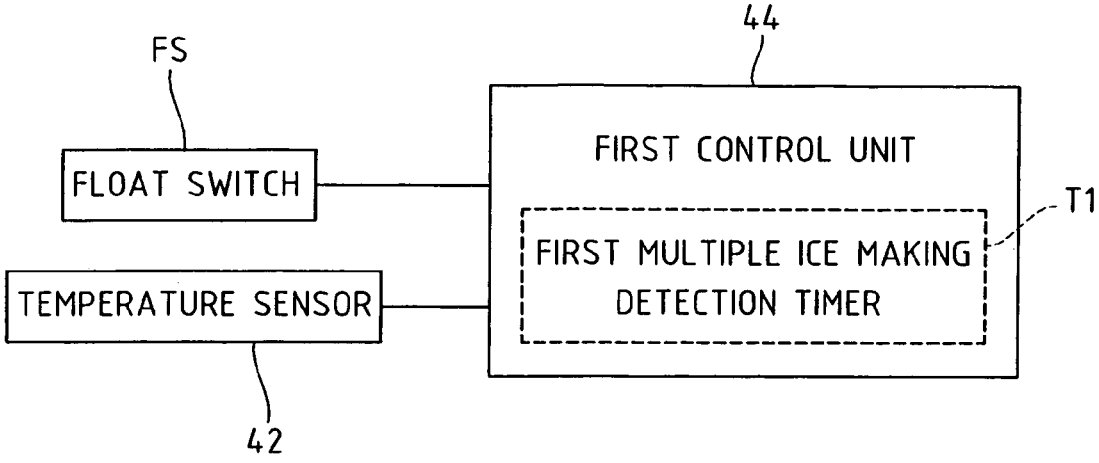
FIG. 2 is a block diagram of a control system which executes the multiple ice making decision method and the operation method according to the first embodiment.

FIG. 2 shows the control system for the falling type ice making machine according to the first embodiment, the ice making machine has the first control unit 44, comprised of a microcomputer or the like which performs the general electric control, and the float switch FS and the temperature sensor 42 are connected to the control unit 44. The first control unit 44 performs control to stop the ice making step and switches it to the deicing step when the water level in the ice-making-water tank 22 drops to the defined water level WL and the float switch FS is set off from on (detection of the defined water level WL) after the ice making step is initiated. The first control unit 44 is set in such a way as to decide that deicing is completed as the temperature sensor 42 detects that the temperature of the hot gas, which rises abruptly due to separation of lumps of ice M from the ice making plates 10 and 10 heated by the hot gas supplied to the evaporation pipe 14 after the deicing step is initiated, has reached a preset deicing completion temperature, and performs control to stop the deicing step and switches it to the ice making step.

The first control unit 44 has a first multiple ice making detection timer T1 which is set to start a counting operation (ON) at the same time as the ice making step starts. The first multiple ice making detection timer T1 is set with a normal ice making time tm needed for the float switch FS to detect the defined water level WL since the initiation of the ice making step when the storage state or the like of lumps of ice M is normal. The first control unit 44 is set in such a way that when the float switch FS detects the defined water level WL before the first multiple ice making detection timer T1 counts up, i.e., the time needed to complete ice making is shorter than the normal ice making time tm, it counts considering the ice making step at that time as short ice making. The first control unit 44 is set in such a way that when detecting consecutive occurrence of the ice making step with short ice making by a predetermined number of times (N times), the first control unit 44 decides that multiple ice making has occurred and performs control to stop the operation of the ice making machine immediately. When the ice making step is returned to the ice making step with the normal ice making time tm after short ice making is counted, the count is reset. The consecutive number of ice making steps with short ice making for determining multiple ice making is set to such a value that the ice making plates 10 or the like are not damaged by an increase in lumps of ice M near the ice making plates.

Operation of First Embodiment

Figure 3:
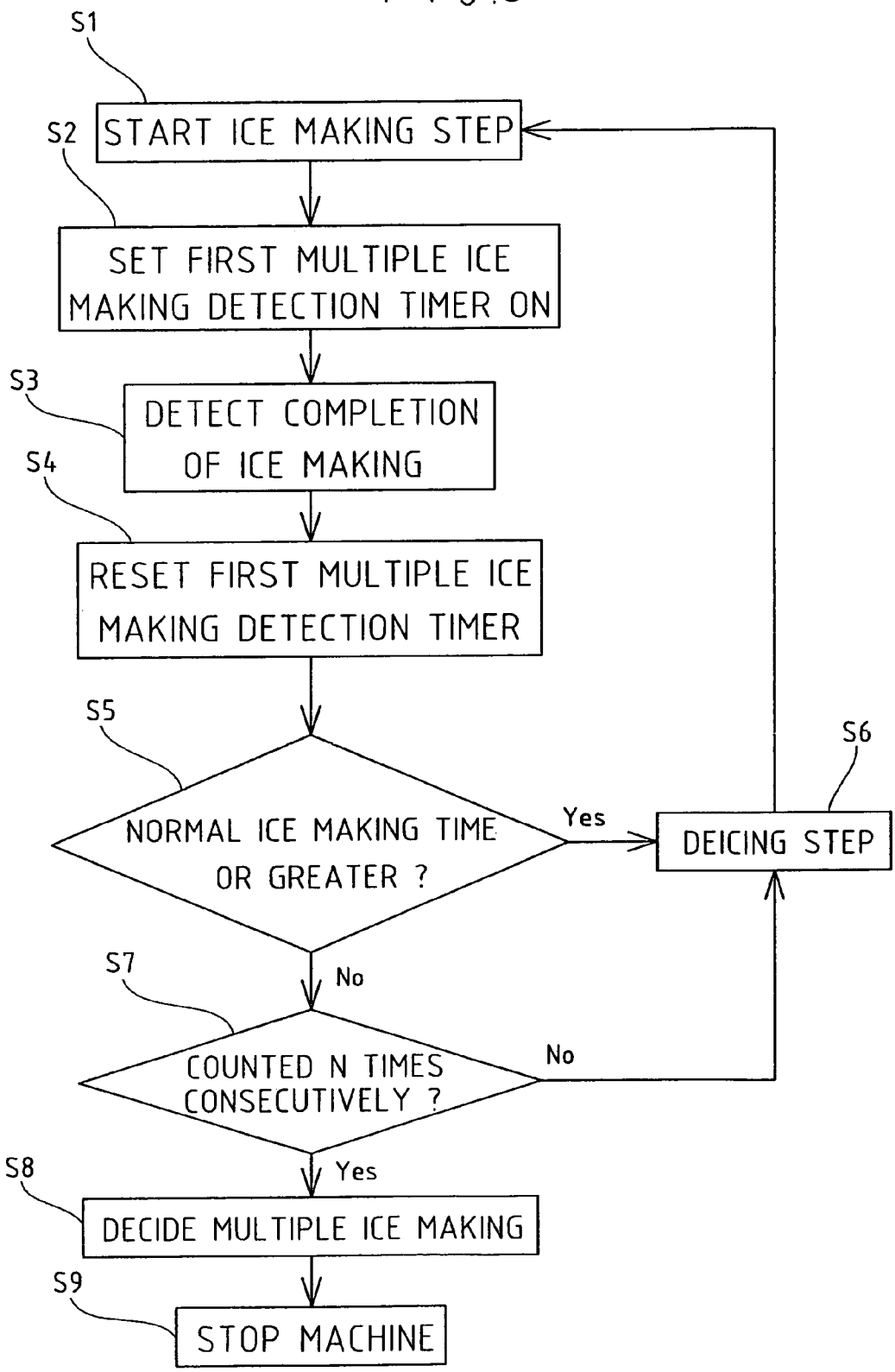
FIG. 3 is a flowchart which is carried out by the multiple ice making decision method and the operation method according to the first embodiment.

Next, the multiple ice making decision method and the operation method for an automatic ice making machine according to the first embodiment will be described referring to a flowchart in FIG. 3.

When the ice making step in the falling type ice making machine starts (step S1), the compressor CM, the circulation pump PM and the cooling fan FM are activated (ON), and the first multiple ice making detection timer T1 starts a counting operation (ON) (step S2). At this time, ice making water is retained in the ice-making-water tank 22 to the upper water level defined by the overflow pipe 30, and the float switch FS is at the ON state.

As the ice making step starts, the ice making plates 10 and 10 in each ice making section 16 is forcibly cooled by heat exchange with the refrigerant that circulates in the evaporation pipe 14, and the ice making water which is supplied to the ice making surfaces of the ice making plates 10 and 10 via the circulation pump PM from the ice-making-water tank 22 gradually starts being iced. The ice making water that falls from the ice making surfaces without being iced is collected into the ice-making-water tank 22 via the through holes of the ice guide plate 20 and is supplied again to the ice making plates 10 and 10.

As complete lumps of ice M are produced at the ice making plates 10 and 10 and the float switch FS detects the defined water level WL (action from ON to OFF), the first control unit 44 detects completion of ice making (step S3), and resets the first multiple ice making detection timer T1 (step S4). If the first multiple ice making detection timer T1 has counted up (the normal ice making time tm has passed) when the float switch FS detects the defined water level WL (YES at step S5), the first control unit 44 decides that ice making step has been carried out in the normal state and initiates the deicing step (step S6). If the first multiple ice making detection timer T1 has not counted up when the float switch FS detects the defined water level WL (NO at step S5), the first control unit 44 counts, considering that short ice making has been done. If the first control unit 44 has not counted short ice making N times consecutively (NO at step S7), the deicing step is initiated without stopping the ice making machine.

As the step goes to the deicing step, the hot gas valve HV is opened, circulatively supplying the hot gas to the evaporation pipe 14. When lumps of ice M are completely separated from the ice making plates 10 and 10 of each ice making section 16 through this deicing step and the temperature sensor 42 detects a rise in the temperature of the hot gas (deicing completion temperature), the first control unit 44 terminates the deicing step and goes to the ice making step.

In an abnormal state where lumps of ice M are stored up to the vicinity of the ice making plates or excessive lumps of ice M remain without being discharged to the stocker 18 due to an operational failure or the like of the ice detection means disposed in the stocker 18, as mentioned above, the amount of ice making water in the ice-making-water tank 22 decreases quickly as originated from the flow of a part of ice making water to be supplied to the ice making plates 10 and 10 at the ice making step into the stocker 18 along the lumps of ice M. Before the first multiple ice making detection timer T1 counts up, therefore, the float switch FS detects the defined water level WL and ice making is completed. Even in the ice making step thereafter, therefore, ice making is completed in a shorter time than the normal ice making time tm, so that the first control unit 44 consecutively counts the ice making step with short ice making.

When the first control unit 44 counts the ice making step with short ice making N times consecutively (YES at step S7), the first control unit 44 decides that multiple ice making has occurred (step S8), and stops operating the ice making machine (machine stop) (step S9). That is, the ice making plates 10 or the like are prevented from being damaged by the repetition of the ice making and deicing cycle with multiple ice making occurred. As multiple ice making can be detected without using a special switch or a sensor or the like for detecting multiple ice making, the cost does not increase. If short ice making does not occur consecutively when the number of counts of short ice making is less than a preset number (N times), the count is reset, so that the machine is not stopped unnecessarily when the multiple ice making state is canceled naturally or the like.

Second Embodiment

Figure 4:
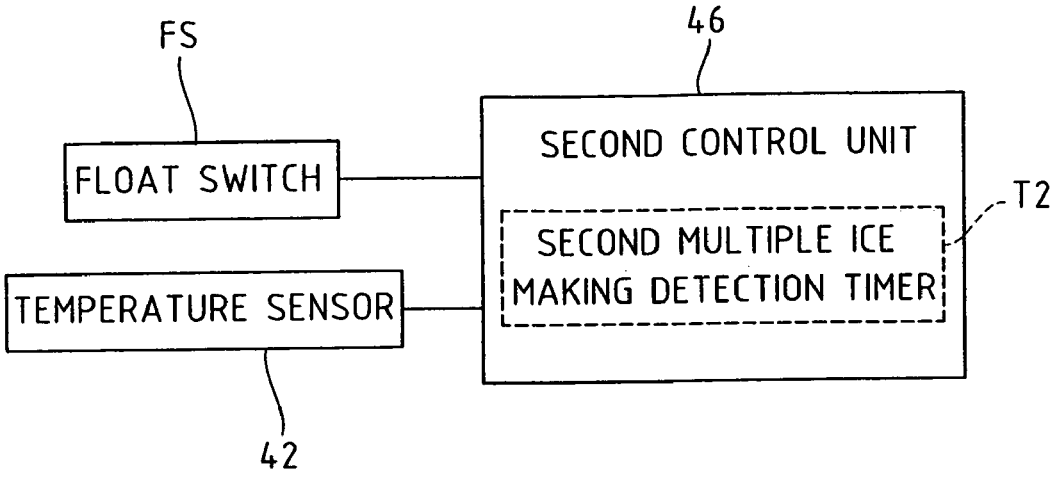
FIG. 4 is a block diagram of a control system which executes a multiple ice making decision method and an operation method according to a second embodiment.

FIG. 4 shows the control system for a falling type ice making machine according to the second embodiment. As the basic structure of the ice making machine is the same as that of the first embodiment, the detailed description will be omitted.

A second control unit 46 of the ice making machine of the second embodiment is connected with the float switch FS and the temperature sensor 42, and has a second multiple ice making detection timer T2 which starts a counting operation at the same time as the ice making step starts. The second multiple ice making detection timer T2 is set with a normal drop time tn needed for the temperature sensor 42 which detects the refrigerant temperature at the outlet side of the evaporation pipe 14 to detect a preset temperature (e.g., 2° C.) K1 after the ice making step has started in the normal state.

The second control unit 46 is set in such a way that when the second multiple ice making detection timer T2 counts up before the temperature sensor 42 detects the set temperature K1, i.e., when the time needed to detect the set temperature K1 is shorter than the normal drop time tn, the second control unit 46 decides that the refrigerant temperature at the outlet side of the evaporation pipe 14 has fallen in a short time due to the occurrence of some sort of abnormality, and counts the ice making step at that time as being ice making with the refrigerant temperature dropped in a short time. The second control unit 46 is set in such a way that when the ice making step with the refrigerant temperature dropped in a short time is counted a predetermined number of times (N times) consecutively, the second control unit 46 decides that multiple ice making has occurred and performs control to immediately stop operating the ice making machine. When the ice making step at the normal drop time tn is returned after the ice making step with the refrigerant temperature dropped in a short time is counted, the count is reset. The consecutive number of ice making steps with the refrigerant temperature dropped in a short time for determining multiple ice making is set to such a value that the ice making plates 10 or the like are not damaged by an increase in lumps of ice M near the ice making plates.

Operation of Second Embodiment

Figure 5:
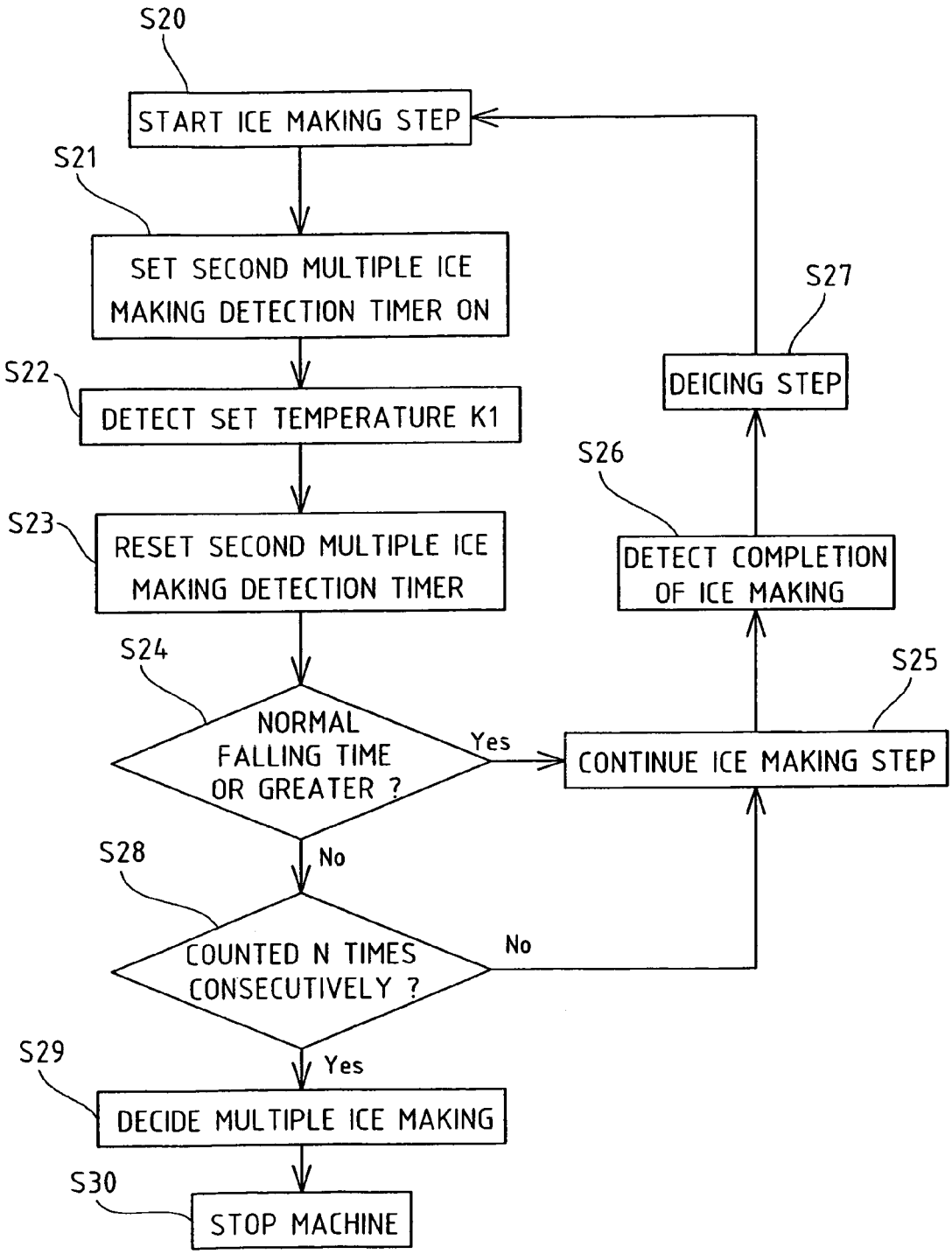
FIG. 5 is a flowchart which is carried out by the multiple ice making decision method and the operation method according to the second embodiment.

Next, the multiple ice making decision method and the operation method for an automatic ice making machine according to the second embodiment will be described referring to a flowchart in FIG. 5.

When the ice making step in the falling type ice making machine starts (step S20), the compressor CM, the circulation pump PM and the cooling fan FM are activated (ON), and the second multiple ice making detection timer T2 starts a counting operation (ON) (step S21). At this time, ice making water is retained in the ice-making-water tank 22 to the upper water level defined by the overflow pipe 30, and the float switch FS is at the ON state.

As the ice making step starts, the ice making plates 10 and 10 in each ice making section 16 is forcibly cooled by heat exchange with the refrigerant that circulates in the evaporation pipe 14, and the ice making water which is supplied to the ice making surfaces of the ice making plates 10 and 10 via the circulation pump PM from the ice-making-water tank 22 gradually starts being iced. The ice making water that falls from the ice making surfaces without being iced is collected into the ice-making-water tank 22 via the through holes of the ice guide plate 20 and is supplied again to the ice making plates 10 and 10.

After confirming that the refrigerant temperature at the outlet side which is detected by the temperature sensor 42 becomes the set temperature K1, the second control unit 46 resets the second multiple ice making detection timer T2 (steps S22 and S23). If the second multiple ice making detection timer T2 has counted up when the temperature sensor 42 detects the set temperature K1 (YES at step S24), the second control unit 46 decides that the ice making step in the normal state is carried out and continues the ice making step (step S25). When completion of ice making is detected as a consequence of the float switch FS becoming OFF (step S26), the deicing step is initiated (step S27). In this deicing step, as per the first embodiment, the ice making plates 10 and 10 of each ice making section 16 are heated by the hot gas which is circulatively supplied to the evaporation pipe 14 as the hot gas valve HV is opened, thus separating lumps of ice M. When the temperature sensor 42 detects a rise in the temperature of the hot gas (deicing completion temperature), the second control unit 46 terminates the deicing step and goes to the ice making step.

If the second multiple ice making detection timer T2 has not counted up when the temperature sensor 42 detects the set temperature K1 (NO at step S24) in the flow of the ice making step, on the other hand, the second control unit 46 counts considering that the ice making step with the refrigerant temperature dropped in a short time is carried out. If the ice making step with the refrigerant temperature dropped in a short time is not counted N times consecutively by the second control unit 46 (NO at step S28), the ice making step is continued without stopping the ice making machine.

When the second control unit 46 consecutively counts the ice making step with the refrigerant temperature dropped in a short time N times (YES at step S28), the second control unit 46 decides that multiple ice making has occurred (step S29) and stops operating the ice making machine (machine stop) right away (step S30). That is, the ice making plates 10 or the like are prevented from being damaged by the repetition of the ice making and deicing cycle with multiple ice making occurred. As multiple ice making is detected without using a special switch or a sensor or the like for detecting multiple ice making, the cost does not increase. If short ice making does not occur consecutively when the number of counts of ice making with the refrigerant temperature dropped in a short period is less than a preset number (N times), the count is reset, so that the machine is not stopped unnecessarily when the multiple ice making state is canceled naturally or the like.

Third Embodiment

Figure 6:
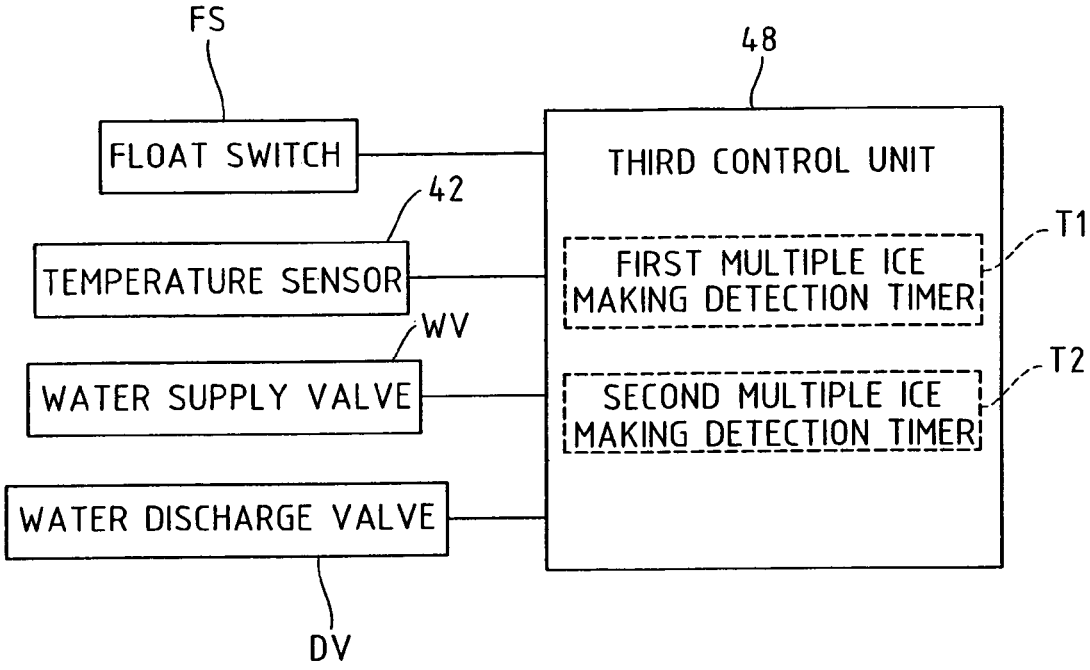
FIG. 6 is a block diagram of a control system which executes a multiple ice making decision method and an operation method according to a third embodiment.

FIG. 6 shows the control system for a falling type ice making machine according to the third embodiment. As the basic structure of the ice making machine is the same as that of the first embodiment, the detailed description will be omitted.

A third control unit 48 of the ice making machine of the third embodiment is connected with the water supply valve WV and the water discharge valve DV as well as the float switch FS and the temperature sensor 42. The third control unit 48 has the first and second multiple ice making detection timers T1 and T2 which start a counting operation at the same time as the ice making step starts. That is, the third control unit 48 is constructed in such a way as to determine multiple ice making by using the multiple ice making decision method which has been described in the above-described first embodiment and second embodiment. The third control unit 48 is set in such a way that when it is decided that multiple ice making has occurred, the third control unit 48 controls the opening/closing of the water discharge valve DV and the water supply valve WV while the operation of the compressor CM in the refrigeration system 12 is stopped, and repeats the cycle of the discharge of ice making water in the ice-making-water tank 22, supply of new ice making water to the ice-making-water tank 22 and circulative supply of ice making water to the ice making sections 16 (multiple ice making canceling cycle) a predetermined number of times (X times).

The number of times the multiple ice making canceling cycle is carried out is set to such a value as to be able to melt lumps of ice M located near the ice making plates with ice making water and return the state to the normal one.

Operation of Third Embodiment

Next, the multiple ice making decision method and the operation method for an automatic ice making machine according to the third embodiment will be described referring to a flowchart in FIG. 7. With regard to an operation similar to those of the first and second embodiments, the description will be omitted.

When the ice making step in the falling type ice making machine starts (step S40), the flow of counting short ice making originated from multiple ice making (steps S41–S43 to S44) or counting the ice making step with the refrigerant temperature dropped in a short time (steps S49–S51 to S44) is executed, and if each count value is not N, the deicing step takes place as done in the above description. When short ice making or the ice making step with the refrigerant temperature dropped in a short time is carried out N times consecutively (YES at step S48), the third control unit 48 decides that multiple ice making has occurred (step S52) and executes the flow of steps S53 to S58.

That is, first, the compressor CM of the refrigeration system 12 is stopped (step S53). With that done, the water discharge valve DV of the ice-making-water tank 22 is opened to discharge ice making water remaining in the tank 22 (step S54). Next, the water discharge valve DV is closed and the water supply valve WV is opened to supply only a required amount of new ice making water (city water) into the ice-making-water tank 22, after which the water supply valve WV is closed (steps S55 and S56). Thereafter, the circulation pump PM is operated to circulatively supply ice making water in the ice-making-water tank 22 to each ice making section 16 (step S57).

As the refrigerant is not supplied to the evaporation pipe 14 in the ice making section 16, ice making water is not cooled and ice making water at normal temperature circulates between the ice making section 16 and the ice-making-water tank 22, so that lumps of ice M present near the ice making plates are melted by the normal-temperature ice making water. Then, the circulation pump PM is stopped after a predetermined time (e.g., 30 minutes), and the third control unit 48 counts considering that the multiple ice making canceling cycle at steps S54 to S57 has been completed once. If the counted multiple ice making canceling cycle is less than the preset X times (NO at step S58), the third control unit 48 repeats the aforementioned steps. It is to be noted however that when the multiple ice making canceling cycle becomes X times, the ice making step is initiated.

That is, according to the operation method of the third embodiment, multiple ice making can be canceled automatically by efficiently melting lumps of ice M near the ice making plates, which are cause for multiple ice making, with circulative supply of normal-temperature ice making water. Even in a time when an operator is not present, such as in the night or the like, therefore, the ice making machine is not left stopped over a long period of time and is automatically restored to be able to produce lumps of ice M.

Modification

Although the multiple ice making canceling cycle is executed after the occurrence of multiple ice making is decided according to the third embodiment, the ice making machine can be stopped immediately. The structure of the ice making section is not limited to the structure comprising two ice making plates as in each embodiment, it may be of a type where the evaporation pipe is laid out at the back of the ice making plate. Further, the ice making section is not limited to the structure having plural ice making sections in parallel, but a single ice making section alone is provided.

The invention claimed is:

1. A multiple ice making decision method for an automatic ice making machine, which alternately repeats an ice making step of cooling an ice making section where an evaporator constituting a refrigeration system by circulatively supplying a refrigerant to said evaporator, and producing lumps of ice by circulatively supplying ice making water, retained in an ice-making-water tank, to said ice making section, and a deicing step of separating said lumps of ice produced at said ice making section; and in which a first control unit for switching the ice making step to the deicing step when a float switch installed inside the ice-making-water tank detects that a water level in the ice-making-water tank drops to a defined water level is provided, said method being characterized in that the first control unit is provided with a first multiple ice making detection timer which is set to start a counting operation at a same time as the ice making step starts; and during the ice making step, when the float switch detects the defined water level before the first multiple ice making detection timer counts up a normal ice making time, the first control unit counts considering the ice making step as short ice making, and said first control unit is set in such a way that when said first control unit detects, a predetermined number of times, consecutive occurrence of the ice making step of short ice making, said first control unit decides that multiple ice making has occurred.

2. An operation method for an automatic ice making machine, characterized in that an operation of the ice making machine is stopped when it is decided that multiple ice making has occurred by a multiple ice making decision method for an automatic ice making machine as recited in claim 1.

* * * * *